US008491095B2

(12) United States Patent
McNees et al.

(10) Patent No.: US 8,491,095 B2
(45) Date of Patent: Jul. 23, 2013

(54) FLUID EJECTION DEVICE AND METHOD FOR FABRICATING FLUID EJECTION DEVICE

(75) Inventors: Andrew L. McNees, Lexington, KY (US); David L. Bernard, Lexington, KY (US); Paul W. Dryer, Lexington, KY (US); Sean T. Weaver, Union, KY (US); Eric S. Hall, Lexington, KY (US)

(73) Assignee: Funai Electric Co., Ltd. (JP)

( * ) Notice: Subject to any disclaimer, the term of this patent is extended or adjusted under 35 U.S.C. 154(b) by 373 days.

(21) Appl. No.: 13/041,793

(22) Filed: Mar. 7, 2011

(65) Prior Publication Data

US 2012/0229569 A1 Sep. 13, 2012

(51) Int. Cl.
*B41J 2/16* (2006.01)

(52) U.S. Cl.
USPC ..... 347/47; 347/65

(58) Field of Classification Search
USPC ..... 347/40, 42–45, 48–50, 58–59, 65, 347/72
See application file for complete search history.

(56) References Cited

U.S. PATENT DOCUMENTS 7,125,097 B2 * 10/2006 Sekiguchi ..... 347/42
7,604,333 B2 * 10/2009 Horsnell et al. ..... 347/85

* cited by examiner

*Primary Examiner* — Thinh Nguyen
(74) *Attorney, Agent, or Firm* — Amster, Rothstein & Ebenstein LLP

(57) ABSTRACT

Disclosed is a fluid ejection device that includes a nozzle plate. The nozzle plate includes a plurality of nozzles for fluid ejection. Further, the fluid ejection device includes a substrate disposed below the nozzle plate. The substrate includes a top surface adapted to adhere to the nozzle plate. The substrate also includes at least one fluid via configured within the substrate for providing fluid to the plurality of nozzles of the nozzle plate. Furthermore, the fluid ejection device includes at least one supporting structure configured within each fluid via of the at least one fluid via. The at least one supporting structure is further configured at a predetermined depth from the top surface of the substrate to regulate the flow of the fluid from the at least one fluid via to the plurality of nozzles. Further, disclosed is a method to fabricate the fluid ejection device.

20 Claims, 8 Drawing Sheets

FLUID EJECTION DEVICE AND METHOD FOR FABRICATING FLUID EJECTION DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to fluid ejection devices, and more particularly, to a fluid ejection device adapted to prevent bulging of a nozzle plate over fluid vias of the fluid ejection device on an exposure to a fluid, such as ink.

2. Description of the Related Art

Presently, fluid ejection devices, such as inkjet printheads, are configured to have fluid vias constructed within a substrate, such as a silicon wafer, by various conventional methods. Such conventional methods include spinning of a positive resist material on an entire silicon wafer used for making the fluid ejection devices, and exposing areas corresponding to fluid vias while masking remaining areas of the silicon wafer with a photo reticle. Subsequently, the exposed positive resist material is developed away from the areas that correspond to the fluid vias. Thereafter, silicon material in the fluid vias is etched through the entire silicon wafer. Specifically, techniques such as Deep Reactive Ion Etching (DRIE) may be used to etch the silicon material in the fluid vias. Once the silicon material in the fluid vias is etched, a nozzle plate is laminated on top of a plurality of flow features spanning through the fluid vias. The silicon wafer may then be diced into individual chips, i.e., printheads. The printheads may then be attached to a tab circuit, and then bonded to a fluid bottle, such as a Noryl bottle to form the fluid ejection devices.

However, it is observed that over time, a Photo Imageable Nozzle Plate (PINP) based printhead suffers from bulging of the nozzle plate over fluid vias configured at end portions of the printhead, such as the outermost fluid vias for fluids including cyan ink and black ink, after exposure to the respective type of the fluids. Such a phenomenon is known as "via bulge". Specifically, the bulging of the nozzle plate or the "via bulge" occurs because a silicon sliver deposited on the two outermost fluid vias is very thin (less than 800 micrometers) and may easily get distorted over a time period, while fluid is ejected (for example, during printing). Over time and during repeated usage of the printhead, a force is applied to the edges of the printhead. Such a force may squeeze the printhead and cause the nozzle plate over the outermost fluid vias to bulge. If the bulging of the nozzle plate is severe, then adhesion of the nozzle plate to plurality of flow features may be compromised, thereby, de-lamination of the nozzle plate may occur. Consequently, the de-lamination of the nozzle plate may lead to severe misdirected nozzles, thereby, compromising print quality.

To avert "via bulging", it has been fairly suggested to introduce bridge structures within/across fluid vias of a fluid ejection device. FIG. 1 is one such embodiment. It depicts a fluid ejection device 100 that includes a substrate 10 and a fluid via 20 configured within the substrate 10. The fluid via 20 includes at least one bridge structure 30 spanning across the via 20 that assists in avoiding bulging of a nozzle plate 40 laminated over the substrate 10. Specifically, the at least one bridge structure 30 assists in preventing squeezing of the fluid ejection device 100, thereby, preventing bulging of the nozzle plate 40. Further, the at least one bridge structure 30 may be introduced within the fluid via 20 by placing the at least one bridge structure 30 imaged in a photo reticle used for fabricating the fluid ejection device 100. The at least one bridge structure 30 includes a top surface 32 aligned with a top surface (not shown) of the substrate 10. As depicted in FIG. 1, the nozzle plate 40 may have integrated flow features, such as a plurality of flow features 42, and built-in nozzles, such as a plurality of nozzles 44.

However, it has been thought that bridge structures of this type are typically very thin, and accordingly, are fragile. For example, a printhead without any bridge structure may withstand a drop height ranging from about nine inches to about fifteen inches without breaking. In contrast, a printhead with the foregoing bridge structures may withstand a drop height of only about two inches, thereby resulting in shattering that may prove detrimental to electronic circuitry of the printhead and may also lead to clogging of fluid passages within the printhead.

Further, bridges like FIG. 1 are suspected to affect the flow of fluid to a plurality of heaters (ejection elements) of a printhead, thereby, causing fluid starvation. Specifically, the bridge structures may act as a barrier to fluid flow and may also cause an increase in fluid cross-talk between adjacent ejection elements. For example, when an ejection element fires fluid, most of the fluid is ejected through a nozzle, but a significant amount of the fluid is blown back. The volume/amount of the fluid that is blown back may to enter an adjacent ejection element, if the bridge structure is close enough to the ejection element and is acting as a barrier. Furthermore, bridge structures with flat top surfaces can serve as a source for bubble formation.

Accordingly, there persists a need for an efficient fluid ejection device that is adapted to eliminate/prevent via bulge problem without resulting in additional problems, such as fluid starvation, fluid cross-talk and bubble formation.

SUMMARY OF THE DISCLOSURE

In view of the foregoing disadvantages, the general purpose of the present disclosure is to provide a fluid ejection device and a method for fabricating the fluid ejection device, by including all suspected advantages of contemplated designs, and overcoming the drawbacks inherent therein.

In one aspect, the present disclosure provides a fluid ejection device that includes a nozzle plate. The nozzle plate includes a plurality of nozzles for fluid ejection. Further, the fluid ejection device includes a substrate disposed below the nozzle plate to support the nozzle plate. The substrate includes a top surface adapted to adhere to the nozzle plate. The substrate also includes at least one fluid via configured within the substrate for providing fluid to the plurality of nozzles of the nozzle plate. Furthermore, the fluid ejection device includes at least one supporting structure configured within each fluid via of the at least one fluid via. The at least one supporting structure is further configured at a predetermined depth from the top surface of the substrate to regulate the flow of the fluid from the at least one fluid via to the plurality of nozzles.

According to another aspect, the present disclosure provides a method for fabricating a fluid ejection device. The method includes fabricating a substrate to configure at least one fluid via within the substrate, and to configure at least one supporting structure within each fluid via of the at least one fluid via using a photolithographic gray-scale mask. Each supporting structure of the at least one supporting structure is configured at a predetermined depth from a top surface of the substrate. The method further includes disposing a nozzle plate over the top surface of the substrate.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides a fluid ejection device, such as a printhead, and more specifically, a Photo Imageable Nozzle Plate (PINP) based printhead. Further, the fluid ejection device of the present disclosure may be utilized in a printer, such as an inkjet printer. The fluid ejection device includes a nozzle plate. The nozzle plate includes a plurality of nozzles for fluid ejection. Further, the fluid ejection device includes a substrate disposed below the nozzle plate to support the nozzle plate. The substrate includes a top surface adapted to adhere to the nozzle plate. The substrate also includes at least one fluid via configured within the substrate for providing fluid to the plurality of nozzles of the nozzle plate. Furthermore, the fluid ejection device includes at least one supporting structure configured within each fluid via of the at least one fluid via. The at least one supporting structure is further configured at a predetermined depth from the top surface of the substrate to regulate the flow of the fluid from the at least one fluid via to the plurality of nozzles. The fluid ejection device of the present disclosure is explained in conjunction with FIGS. 2 and 3.

Figure 2:
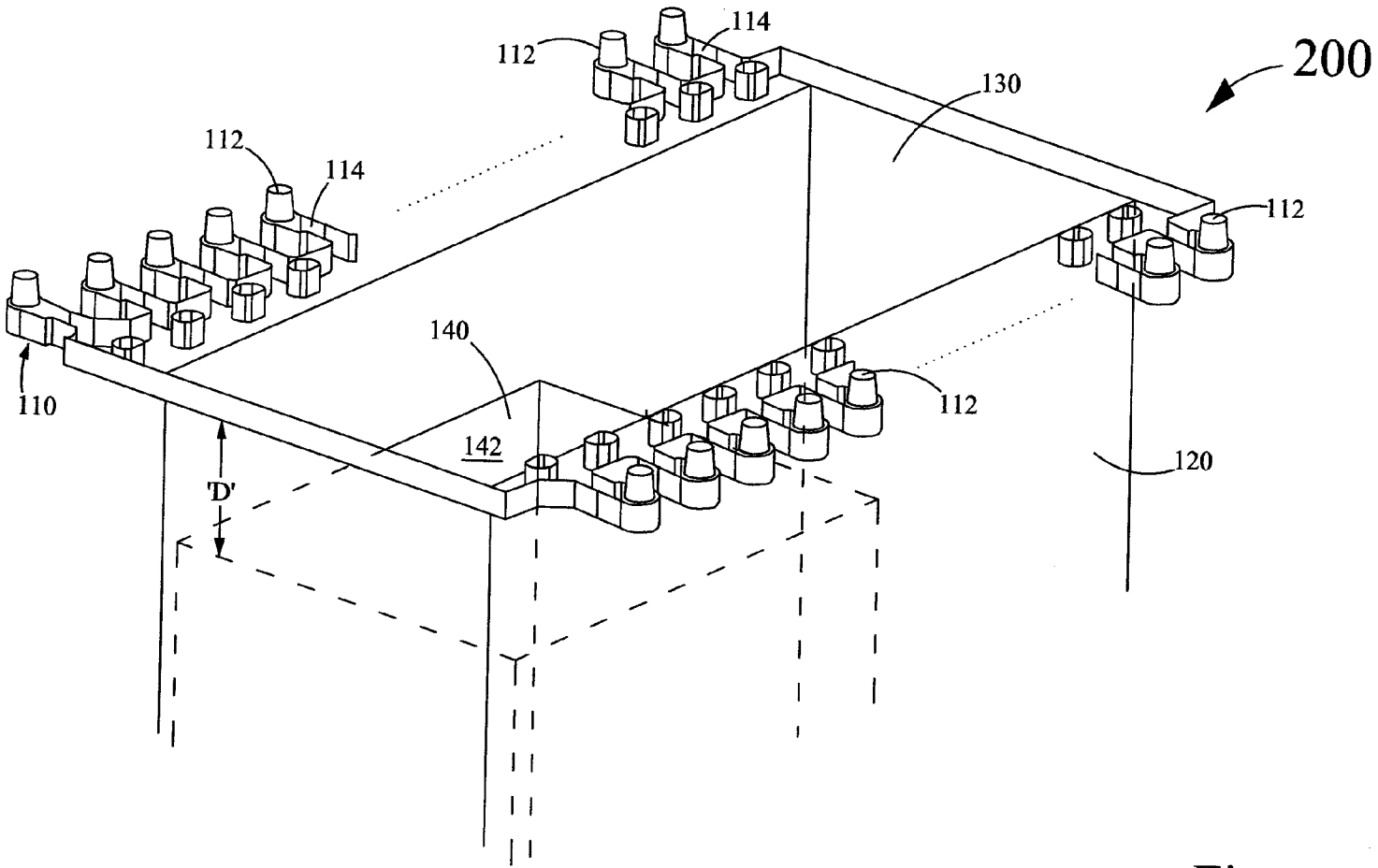
FIG. 2 illustrates a perspective view of a fluid ejection device, in accordance with an embodiment of the present disclosure.

FIG. 2 depicts a perspective view of a fluid ejection device 200, which may be provided in the form of a printhead of a printer, such as an inkjet printer. The fluid ejection device 200 includes a nozzle plate 110 (as shown in FIG. 2). The nozzle plate 110 may be fabricated as a unitary component having an integrated heater chip including ejection elements/heaters (not numbered). As depicted in FIG. 2, the nozzle plate 110 is a rectangular shaped plate. Further, the nozzle plate 110 forms a top portion (not numbered) of the fluid ejection device 200. It is to be understood that the material and shape of the nozzle plate 110 should not be considered as a limitation to the present disclosure, as the material and the shape of the nozzle plate 110 may be chosen as per a manufacturer's preference.

The nozzle plate 110 includes a plurality of nozzles 112 for fluid ejection. The nozzle plate 110 may further include integrated flow features, such as a plurality of flow features 114 fluidly coupled to the nozzles 112. Alternatively, the nozzle plate 110 may simply include the nozzles 112 that may be fluidly coupled to discrete flow features. The nozzles 112 may be configured at edges (not numbered) of the nozzle plate 110 in a longitudinal manner. During printing, the nozzles 112 allow a fluid, such as an ink, to be ejected therefrom on to a medium to be printed. Further, the nozzles 112 may be configured to have a frustum shape, thereby, allowing optimum flow of the fluid therefrom. It is to be understood that the shape and structure of the nozzles 112 should not be considered as a limitation to the present disclosure.

The fluid ejection device 200 further includes a substrate 120 disposed below the nozzle plate 110 to support the nozzle plate 110. The substrate 120 may be composed of a semiconductor material, such as silicon and the like, thereby providing sufficient strength to bear wear and tear during the use of the fluid ejection device 200. According to the present embodiment of the present disclosure, the substrate 120 is a rectangular shaped block. However, the substrate 120 may be configured to have any other shape, without departing from the scope of the present disclosure.

Figure 3:
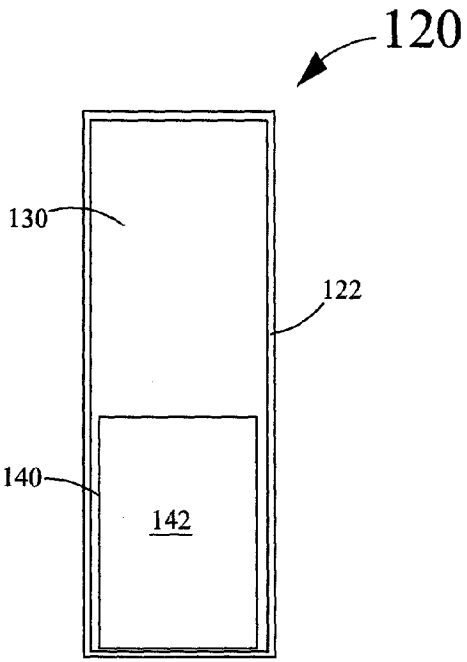
FIG. 3 illustrates a top view of a substrate of the fluid ejection device of FIG. 2, illustrating a fluid via and a supporting structure configured within the fluid via of the substrate.

The substrate 120 includes a top surface 122 (as shown in FIG. 3) that is adapted to adhere to the nozzle plate 110, and specifically, to a bottom surface (not shown) of the nozzle plate 110. The substrate 120 may be attached to the nozzle plate 110 with the help of attachment means, such as an adhesive and the like, as known in the art.

The substrate 120 further includes at least one fluid via 130 configured therewithin, for providing fluid to the nozzles 112 of the nozzle plate 110. For simplicity, the fluid ejection device 200 is depicted to have only one fluid via 130 configured within the substrate 120 (as shown in FIGS. 2 and 3). The fluid via 130 may be configured in the form of a through slot/channel along the thickness of the substrate 120. The fluid via 130 provides a path to the fluid, such as ink, directed towards the nozzles 112 of the nozzle plate 110. For example, during printing, the fluid is transferred from the fluid via 130 towards the nozzles 112 through the flow features 114 of the nozzle plate 110.

Furthermore, the fluid ejection device 200 includes at least one supporting structure 140 configured within the fluid via 130 (as shown in FIGS. 2 and 3). For simplicity, the fluid ejection device 200 is depicted to include only one supporting structure 140 within the fluid via 130. The supporting structure 140 is configured as a sunken bridge structure and is composed of a semiconductor material, such as silicon and the like. The supporting structure 140 is further configured at a predetermined depth ('D') from the top surface 122 of the substrate 120 to regulate the flow of the fluid from the fluid via 130 to the nozzles 112 (as shown in FIGS. 2 and 3). Specifically, the predetermined depth 'D' is the distance between the top surface 122 of the substrate 120 and a top surface 142 of the supporting structure 140. The supporting structure 140 is further configured at the predetermined depth greater than about 50 micrometers and less than about 150 micrometers from the top surface 122 of the substrate 120. Specifically, the predetermined depth is about 100 micrometers.

Accordingly, during printing, the supporting structure 140 provides an optimum flow, i.e. neither a maximum volume nor a minimum volume, of the fluid, such as ink, from the fluid via 130 to the nozzles 112 of the nozzle plate 110, thereby minimizing the effect of compressive forces encountered by the nozzle plate 110 and the fluid via 130. Further, minimization of the compressive forces encountered by the nozzle plate 110 and the fluid via 130 results in eliminating problems associated with fragility of the fluid ejection device 200 and fluid starvation (or cross-talk) within the fluid ejection device 200. Specifically, the utilization of the supporting structure 140 within the fluid via 130 does not affect/block the flow of the fluid to the ejection elements/heaters, thereby, preventing any fluid starvation. It will be evident that the fluid ejection elements of the fluid ejection device 200 may be similar to the conventional fluid ejection elements, and accordingly, the same are not explained herein for the sake of brevity.

Figure 4:
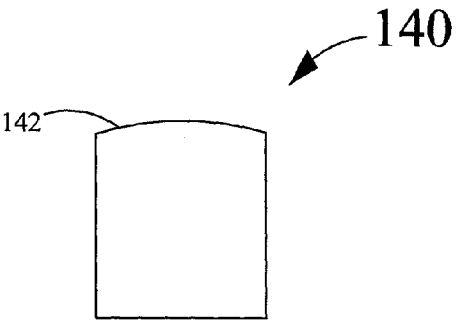
FIG. 4 illustrates a side view of the supporting structure of the fluid ejection device of FIG. 2, in accordance with an embodiment of the present disclosure.
Figure 5:
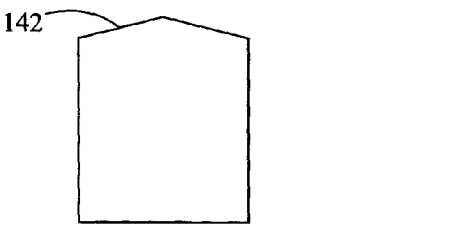
FIG. 5 illustrates a side view of the supporting structure of the fluid ejection device of FIG. 2, in accordance with another embodiment of the present disclosure.

As shown in FIG. 2, the top surface 142 of the supporting structure 140 is configured in the form of a rectangular flat surface. However, the top surface 142 of the supporting structure 140 may be configured to have any other shape. For example, the supporting structure 140 may be configured to have a curved top surface 142, as depicted in FIG. 4. Alternatively, the supporting structure 140 may be configured to have a sloped top surface 142, as depicted in FIG. 5. Such modified shapes of the supporting structure 140 assist in preventing any bubble formation within the fluid ejection device 200.

Figure 6:
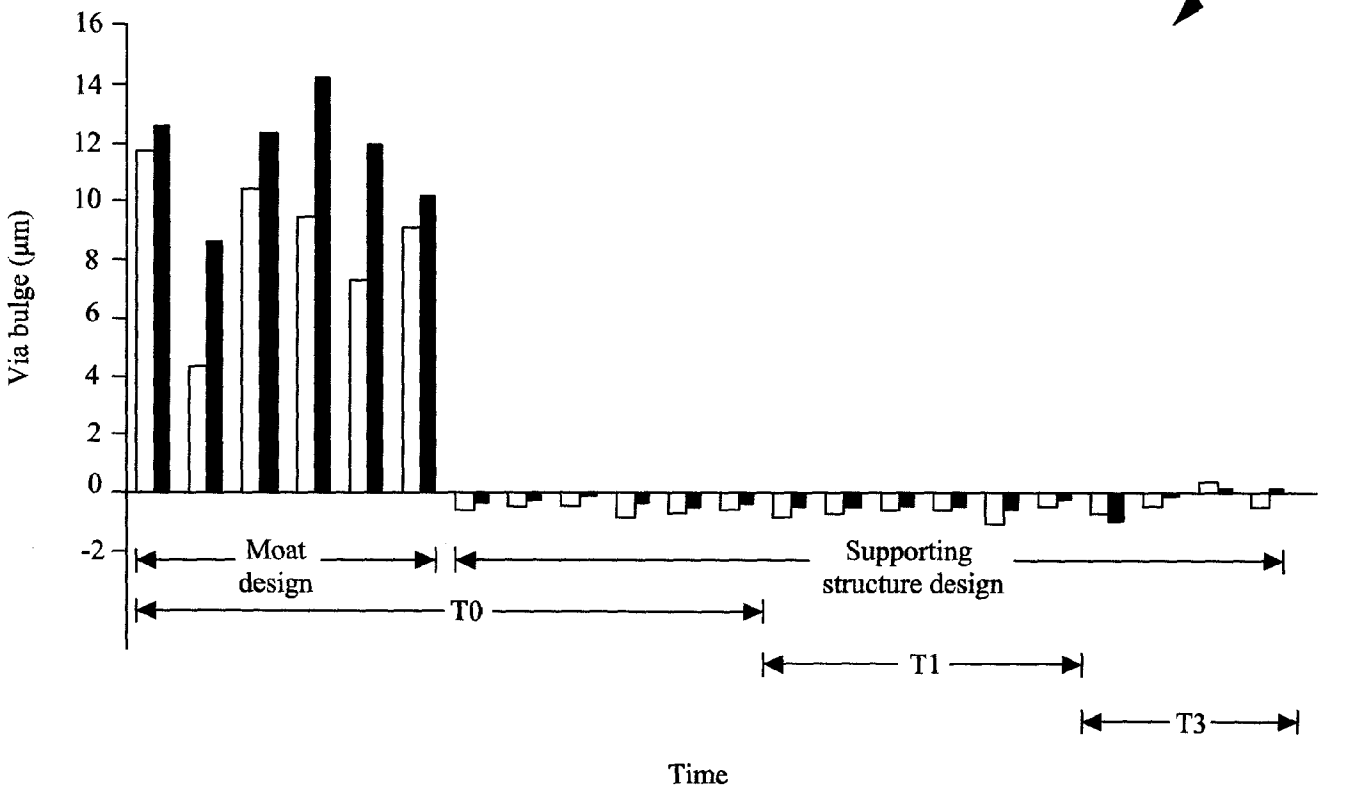
FIG. 6 illustrates a bar graph depicting effectiveness of the supporting structure of the fluid ejection device of FIG. 2 over a conventional Moat design.

Furthermore, the supporting structure 140 of the present disclosure is advantageous over typical designs that are currently used for preventing fluid via bulging. FIG. 6 illustrates a bar graph 300 depicting effectiveness of the supporting structure 140 of the fluid ejection device 200 over a classical (conventional) Moat design used for preventing fluid via bulging. More specifically, and as clearly visible, the fluid via bulge is about 10 micrometers (average) at T0 time interval (prior to soaking in fluid) in a typical Moat design. In contrast, the fluid via bulge is almost negligible at T0, T1 and T3 time intervals, when the supporting structure 140 is used within the fluid via 130.

Further, the supporting structure 140 being configured at the predetermined depth from the top surface 122 of the substrate 120, assists in minimizing cross-talk (or fluid starvation) without being acting as a barrier to fluid flow. Accordingly, cross-talk between adjacent ejection elements (not numbered) of the fluid ejection device 200 does not increase. For example, when an ejection element fires, most of the fluid is ejected through the nozzles 112, however the presence of the supporting structure 140 being configured at the predetermined depth does not allow the remaining volume/amount of the fluid to enter an adjacent ejection element, thereby, reducing the occurrence of any cross-talk. Further, a larger predetermined depth of the supporting structure 140 reduces cross-talk velocity as measured by a velocity magnitude (for firing ejection elements cut off at respective throats). In the typical bridge structure, a bridge depth of about zero micrometer is associated with a cross-talk velocity of 4.4 meters/second at a time interval of about 1.6 microseconds. In contrast, the supporting structure 140 of the present disclosure assists in achieving a cross-talk velocity of about 3 meters/second. Further, the use of the supporting structure 140 allows for a significant reduction in fluid flow across the fluid via 130.

Figure 1:
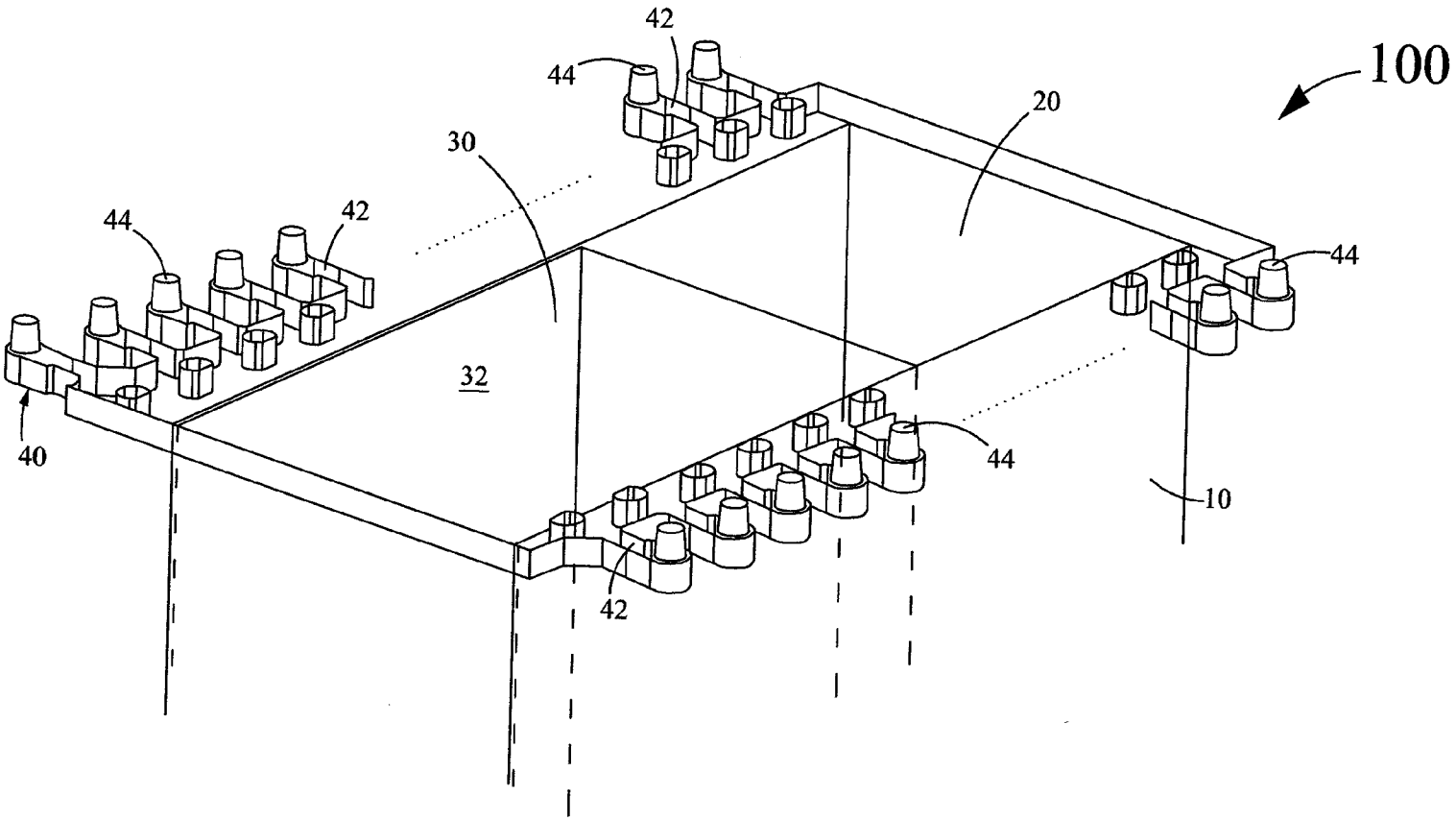
FIG. 1 illustrates a bridge structure contemplated for implementation within a fluid via.
Figure 7:
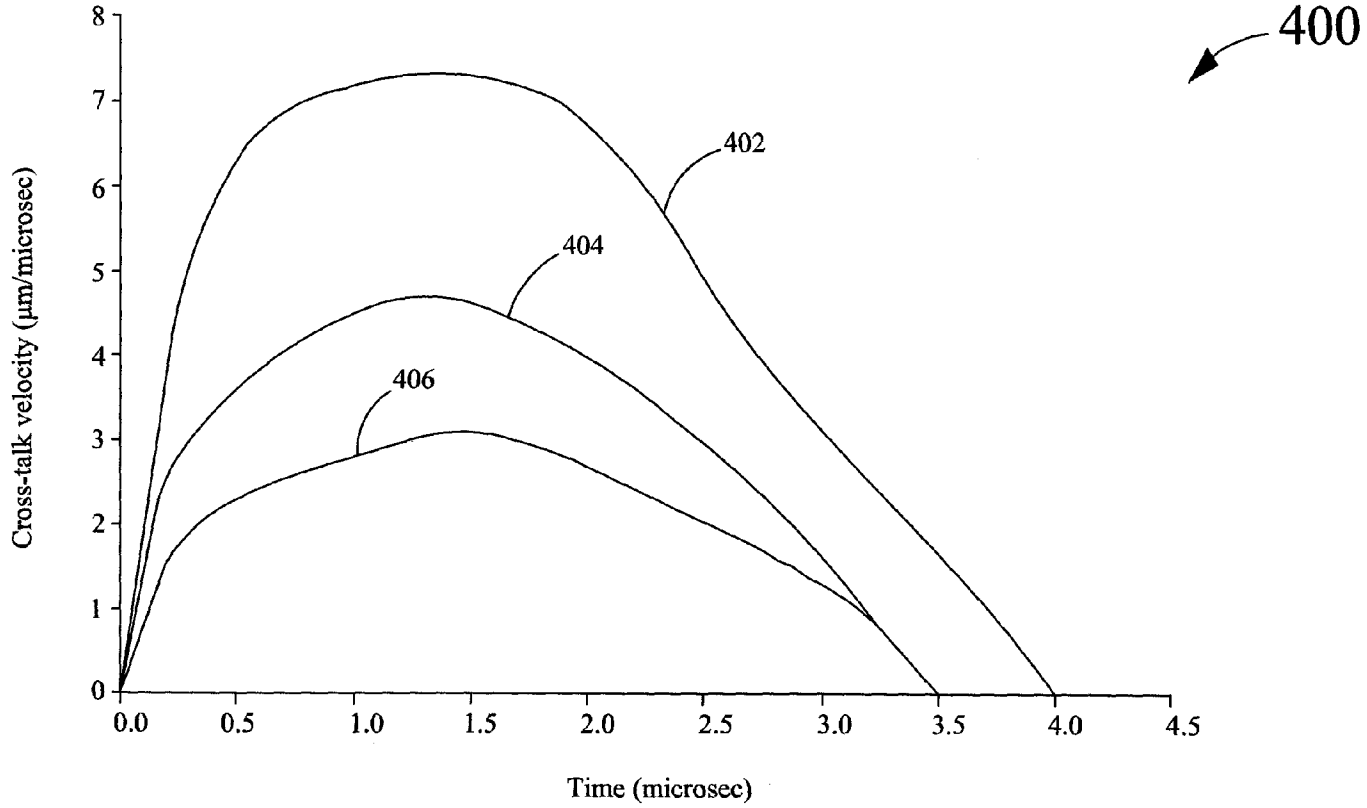
FIG. 7 illustrates a graph for cross-talk velocity versus time for depicting the effect of depth of the supporting structure on displacement of cross-talk fluid within the fluid ejection device of FIG. 2.

Furthermore, FIG. 7 illustrates a graph 400 for cross-talk velocity versus time. Specifically, the graph 400 depicts the cross-talk velocity corresponding to the supporting structure 140 being configured at specific depths of about zero micrometer, similar to the at least one bridge structure 30 of the fluid ejection device 100 of FIG. 1, (as shown by a curve 402), at about 100 micrometers (as shown by a curve 404) and at about 2000 micrometers (as shown by a curve 406). The curve 406 represents a case when no supporting structure 140 is used in the fluid via 130. As illustrated and clearly visible from the graph 400, cross-talk velocity is lowest with no bridge, i.e. the curve 406, and the cross-talk velocity is highest with zero micrometer depth, i.e., the curve 402. Further, areas under each of the curves 402, 404 and 406 are integrated to provide displacement of cross-talk fluid as shown in graph 500 of FIG. 8.

Figure 8:
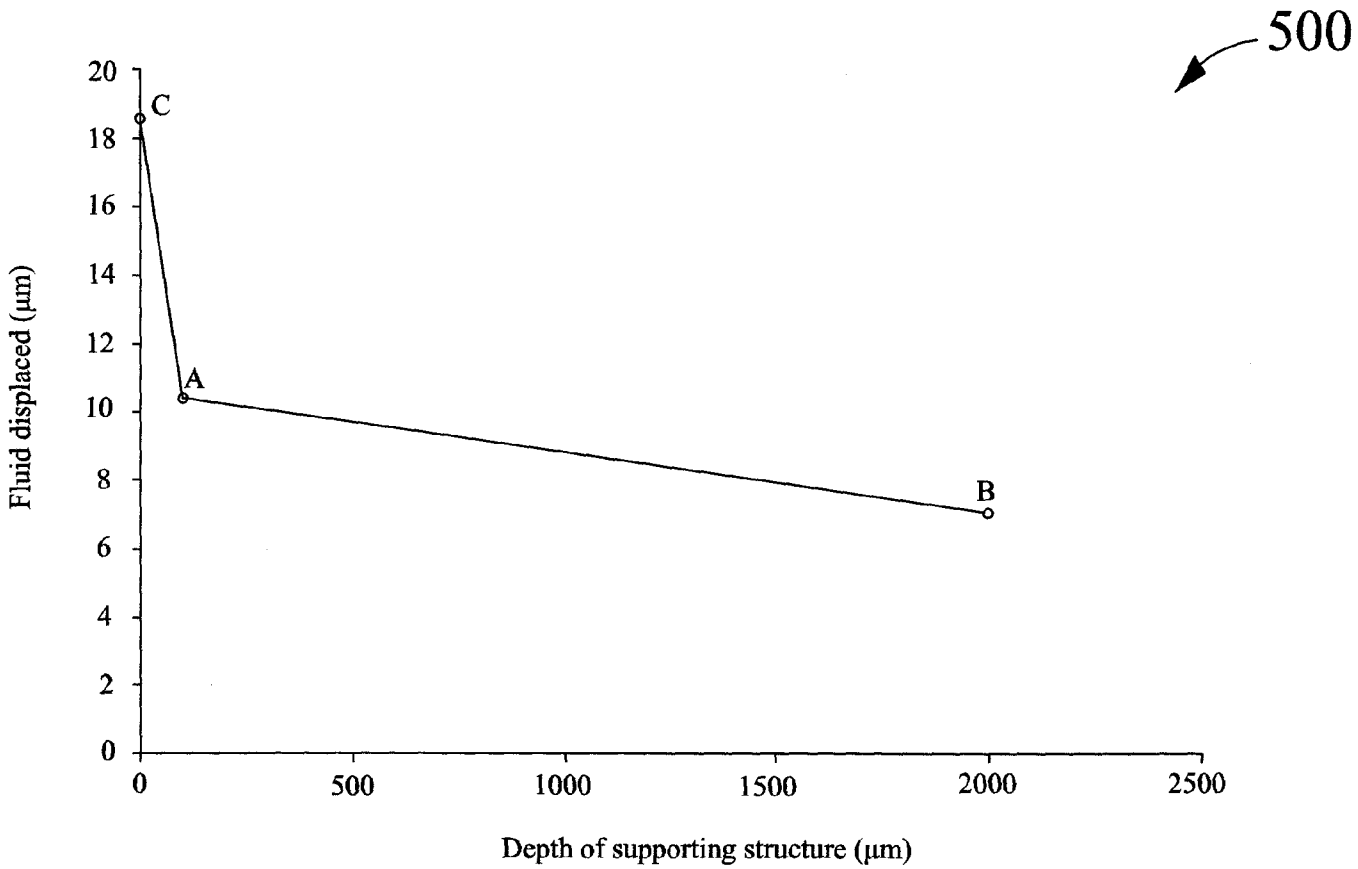
FIG. 8 illustrates a graph for fluid displaced versus depth of the supporting structure of the fluid ejection device of FIG. 2.

According to the graph 500 of FIG. 8, there is about 47 percent increase in cross-talk fluid ejected with the 100 micrometers depth (point 'A'), as compared to the cross-talk fluid ejected with the 2000 micrometers depth (point 'B'). Further, there is a 163 percent increase in the cross-talk fluid ejected with the zero micrometer depth (point 'C') when compared to the cross-talk fluid ejected with the 2000 micrometers depth (point 'B'). Furthermore, the graph 500 of FIG. 8 illustrates drastic increase in the cross-talk fluid ejected with supporting structures of depths lower than about 100 micrometers. Also and as visible from the graph 500, supporting structures with depths greater than about 100 micrometers may be used, however, a very less reduction is gained in terms of cross-talk fluid ejected, while increasing fragility of a fluid ejection device, such as the fluid ejection device 200.

Figure 9:
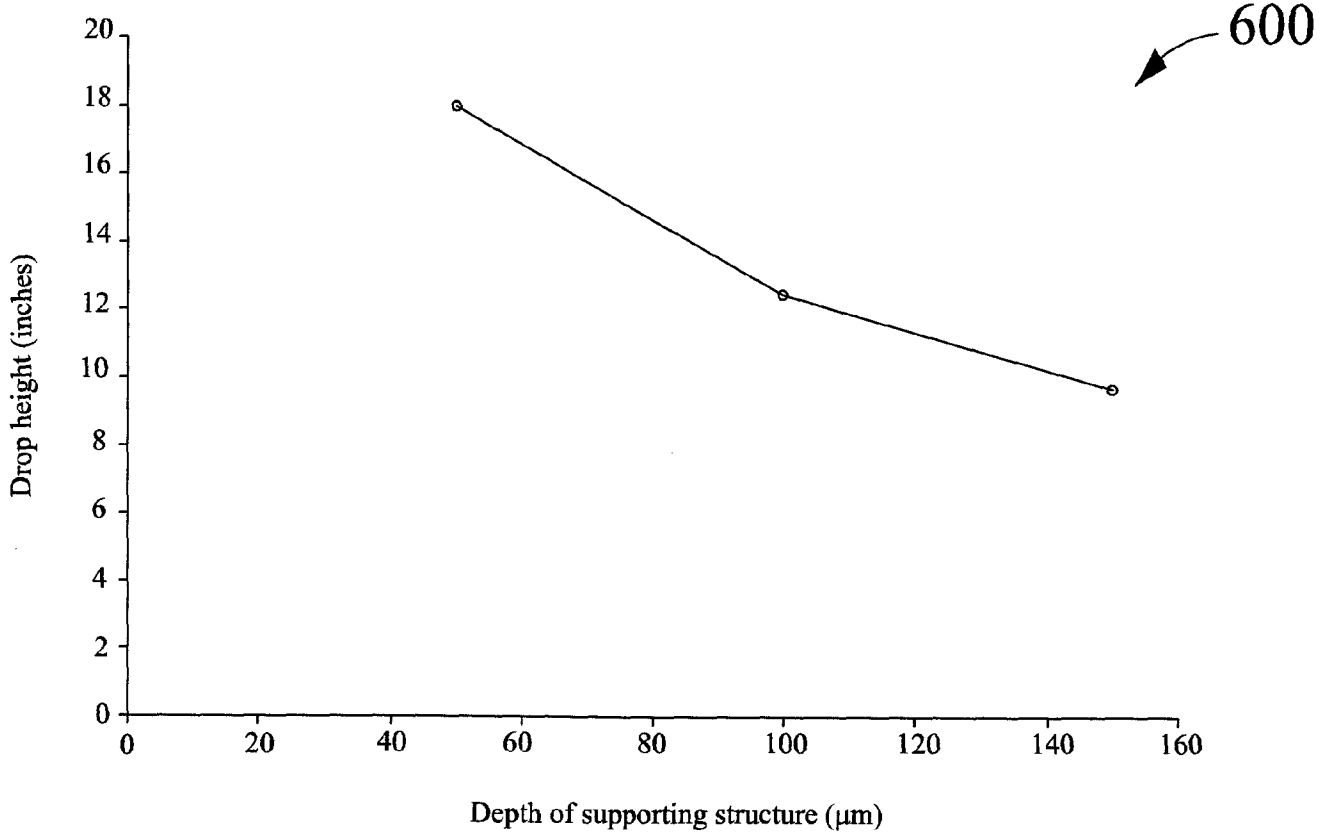
FIG. 9 illustrates a graph for drop height versus depth of the supporting structure of the fluid ejection device of FIG. 2.

In order to overcome problems associated with fragility of the fluid ejection device 200, the supporting structure 140 is configured to have a width ranging from about 300 micrometers to 350 micrometers. Further, as shown in FIG. 9, a graph 600 between drop height and the depth of the supporting structure 140 is illustrated. As visible from the graph 600, the height from which the fluid ejection device 200 may be dropped onto a hard surface such as a floor, desktop and the like, reduces with the increase in the depth of the supporting structure 140. The graph 600 of FIG. 9 thus illustrates a fairly linear decrease in drop height with an increase in the depth of the supporting structure 140. As depicted in FIG. 9, the supporting structure 140 with a width of about 300 micrometers and a depth of about 100 micrometers is capable of withstanding a drop height greater than about 12 inches.

Based on the results of FIGS. 6 to 9, it may be observed that the supporting structure 140 may be configured with an optimal design space with the predetermined depth greater than about 50 micrometers and less than about 150 micrometers, and more specifically, of about 100 micrometers; and a width ranging from about 300 micrometers to about 350 micrometers.

The supporting structure 140 of the fluid ejection device 200 may be configured/formed within the fluid via 130 using a micro-mechanical technique, and specifically, a gray-scale photolithography technique utilizing a gray-scale mask. Specifically, the top surface 122 of the substrate 120 may be spin-coated with a positive resist material. Subsequently, the gray-scale mask is used while exposing, developing and etching the positive resist material. More specifically, the gray-scale mask assists in blocking the entire light incident on the positive resist material, at a first set of areas (not shown) of the substrate 120, thereby creating unetched areas over the substrate 120. Further, the gray-scale mask partially blocks the light incident on the positive resist material, at a second set of areas (not shown) of the substrate 120, thereby creating the supporting structure 140 with flat, sloped, or curved top surface 142. Particularly, various thickness of the positive resist material may be left over the substrate 120 that may result in blocking the light for a specific time period. Accordingly, once the photo-resist material is consumed, the etching proceeds to configure the supporting structure 140 with flat or modified top surface 142. Furthermore, the gray-scale mask does not block the light incident on the positive resist material deposited over the substrate 120 at a third set of areas (not shown) of the substrate 120, thereby creating uniformly etched areas over the substrate 120. The uniformly, etched areas may correspond to fluid vias, such as the fluid via 130 of the fluid ejection device 200.

Figure 10:
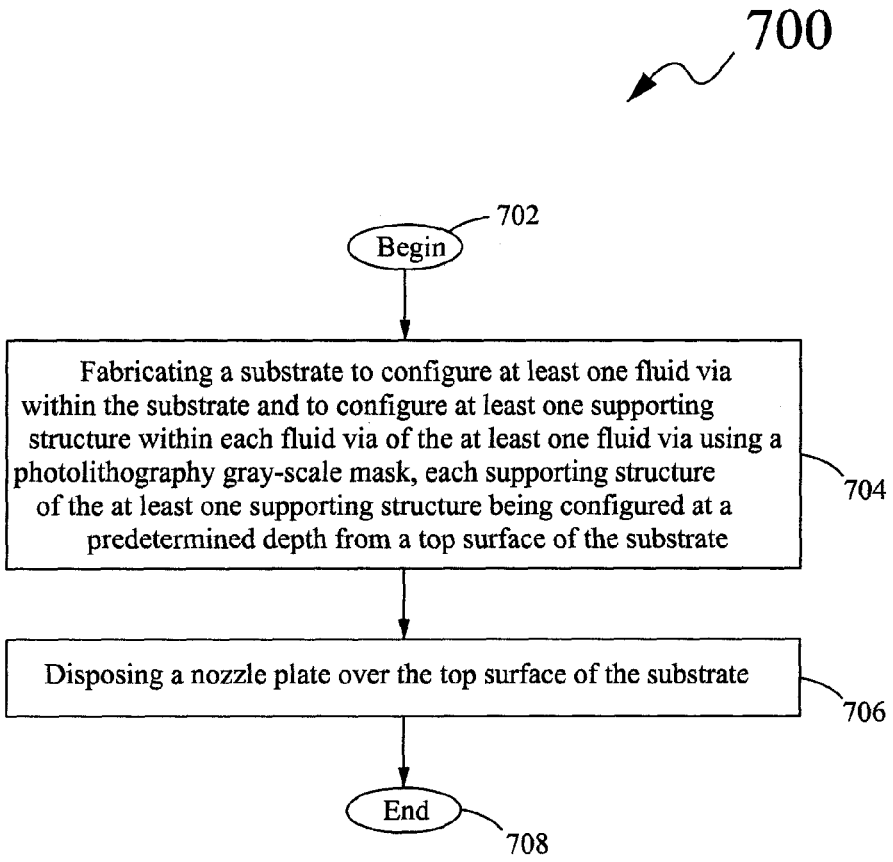
FIG. 10 illustrates a method for fabricating the fluid ejection device of FIG. 2.

In another aspect, the present disclosure provides a method of fabrication of a fluid ejection device, such as the fluid ejection device 200, as explained in conjunction with FIG. 10. Further, reference will be made to the fluid ejection device 200 and components thereof as explained in FIG. 2 for describing the method of FIG. 10.

FIG. 10 illustrates flow chart for a method 700 for fabricating the fluid ejection device 200. The method 700 begins at 702. At 704, a substrate, such as the substrate 120, is fabricated to configure at least one fluid via, such as the fluid via 130, within the substrate 120; and to configure at least one supporting structure, such as the supporting structure 140, within the fluid via 130, using a photolithographic gray-scale mask. Further, the supporting structure 140 is configured at a predetermined depth, such as the predetermined depth 'D,' from a top surface, such as the top surface 122 of the substrate 120. The substrate 120 may be fabricated by applying a layer of a positive resist material onto the top surface 122 of the substrate 120; disposing the photolithographic gray-scale mask configured with a pattern corresponding to the fluid via 130 and the supporting structure 140, over the layer of the positive resist material; exposing and developing the layer of the positive resist material based on the pattern of the photolithographic gray-scale mask; and etching the exposed and developed positive resist material and the substrate 120 based on the pattern to configure the fluid via 130 and the supporting structure 140. Specifically, use of the photolithographic gray-scale mask facilitates in creation of the supporting structure 140 in the form of a sunken bridge that may be constructed to have a sufficient width in order to provide strength to the fluid ejection device 200 against cracking. Further, the top surface 142 of the supporting structure 140 may be micro-machined to yield a modified top surface, such as the curved top surface of FIG. 4 and the sloped top surface of FIG. 5.

At 706, a nozzle plate, such as the nozzle plate 110, is disposed over the top surface 122 of the substrate 120. The method 700 ends at 708.

It will be evident that the substrate 120 may be a silicon wafer itself, which may be fabricated in the above-mentioned manner, and may then be diced to form various fluid ejection devices, such as the fluid ejection device 200, based on the dimension of the silicon wafer.

The present disclosure provides a fluid ejection device (such as the fluid ejection device 200), with at least one supporting structure such as the (supporting structure 140) for eliminating compression of a nozzle plate of the fluid ejection device. Further, the at least one supporting structure is provided as sunken bridges to facilitate a free flow of fluid from fluid vias to flow features of the fluid ejection device, while eliminating/preventing the problems associated with fragility of the fluid ejection device and fluid starvation within the fluid ejection device.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. A fluid ejection device comprising:

a nozzle plate comprising a plurality of nozzles for fluid ejection;

a substrate disposed below the nozzle plate to support the nozzle plate, the substrate comprising a top surface adapted to adhere to the nozzle plate, the substrate further comprising at least one fluid via configured therewithin for providing fluid to the plurality of nozzles of the nozzle plate; and at least one supporting structure configured within each fluid via of the at least one fluid via, the at least one supporting structure further configured at a predetermined depth from the top surface of the substrate to regulate the flow of the fluid from the at least one fluid via to the plurality of nozzles.

2. The fluid ejection device of claim 1, wherein the at least one supporting structure is formed within the each fluid via using a micro-electromechanical technique.

3. The fluid ejection device of claim 2, wherein the micro-electromechanical technique is a gray-scale photolithography technique.

4. The fluid ejection device of claim 1, wherein the substrate is composed of silicon.

5. The fluid ejection device of claim 1, wherein the at least one supporting structure is composed of silicon.

6. The fluid ejection device of claim 1, wherein each supporting structure of the at least one supporting structure is configured to have a flat top surface.

7. The fluid ejection device of claim 1, wherein each supporting structure of the at least one supporting structure is configured to have a sloped top surface.

8. The fluid ejection device of claim 1, wherein each supporting structure of the at least one supporting structure is configured to have a curved top surface.

9. The fluid ejection device of claim 1, wherein the predetermined depth is greater than about 50 micrometers and less than about 150 micrometers.

10. The fluid ejection device of claim 9, wherein the predetermined depth is about 100 micrometers.

11. The fluid ejection device of claim 1, wherein each supporting structure of the at least one supporting structure is configured to have a width ranging from about 300 micrometers to about 350 micrometers.

12. A method of fabricating a fluid ejection device, the method comprising:

fabricating a substrate to configure at least one fluid via within the substrate and to configure at least one supporting structure within each fluid via of the at least one fluid via using a photolithographic gray-scale mask, each supporting structure of the at least one supporting structure being configured at a predetermined depth from a top surface of the substrate; and disposing a nozzle plate over the top surface of the substrate.

13. The method of claim 12, wherein fabricating the substrate to configure the each fluid via of the at least one fluid via within the substrate and to configure the at least one supporting structure within the each fluid via comprises, applying a layer of a positive resist material onto the top surface of the substrate, disposing the photolithographic gray-scale mask configured with a pattern corresponding to the each fluid via and the each supporting structure, over the layer of the positive resist material;

exposing and developing the layer of the positive resist material based on the pattern of the photolithographic gray-scale mask, and etching the exposed and developed positive resist material and the substrate based on the pattern to configure the each fluid via and the at least one supporting structure.

14. The method of claim 12, wherein the substrate is composed of silicon.

15. The method of claim 12, wherein the at least one supporting structure is composed of silicon.

16. The method of claim 12, wherein the each supporting structure of the at least one supporting structure is configured to have a sloped top surface.

17. The method of claim 12, wherein the each supporting structure of the at least one supporting structure is configured to have a curved top surface.

18. The method of claim 12, wherein the predetermined depth is greater than about 50 micrometers and less than about 150 micrometers.

19. The method of claim 18, wherein the predetermined depth is about 100 micrometers.

20. The method of claim 12, wherein the each supporting structure of the at least one supporting structure is configured to have a width ranging from about 300 micrometers to about 350 micrometers.

* * * * *